United States Patent [19]

Pastor

[11] Patent Number: 5,030,161

[45] **Date of Patent: * Jul. 9, 1991**

[54] ALL-FOURS WALKING DOLL

[75] Inventor: Vicente N. Pastor, Onil, Spain

[73] Assignee: Irwin Toy Limited, Toronto, Canada

[ * ] Notice: The portion of the term of this patent subsequent to Nov. 7, 2006 has been disclaimed.

[21] Appl. No.: 429,053

[22] Filed: Oct. 27, 1989

Related U.S. Application Data

[63] Continuation of Ser. No. 158,254, Feb. 19, 1988, Pat. No. 4,878,870.

[51] Int. Cl.[5] ..... A63H 00/00

[52] U.S. Cl. ..... 446/298; 446/300; 446/356

[58] Field of Search ..... 446/298, 306, 317, 356, 446/354, 357, 377, 300, 301

[56] References Cited

U.S. PATENT DOCUMENTS

| | | | |
|---|---|---|---|
| 2,761,243 | 9/1956 | Baggott | 446/377 |
| 2,978,834 | 4/1961 | Gardel | 446/356 |
| 3,514,899 | 6/1970 | Bonanno | 446/298 |
| 3,548,537 | 12/1970 | Robbins | 446/355 |
| 3,851,418 | 12/1974 | Barlow | 446/354 |
| 4,312,150 | 1/1982 | Terzian | 446/354 |
| 4,613,315 | 9/1986 | Kataoka | 446/355 |
| 4,810,226 | 3/1989 | Takahashi | 446/356 |

*Primary Examiner*—Robert A. Hafer
*Assistant Examiner*—Michael Brown
*Attorney, Agent, or Firm*—Ladas & Parry

[57] ABSTRACT

A crawling doll normally in an all-fours position, having inside it a battery-operated mechanism, which, by operation of a cam-connecting rod combination, makes the doll advance on the ground and, with each rotation of the cam, temporarily extends its hands frontwards in a head-down falling attitude, at the same time as it energizes a sound mechanism that reproduces a baby's weeping, subsequently moving the arms back to the initial all-fours position in order to develop the complete cycle of the mechanism.

6 Claims, 4 Drawing Sheets

ALL-FOURS WALKING DOLL

This application is a continuation of Ser. No. 07/158,254, filed on Feb. 19, 1988, now U.S. Pat. No. 4,878,870.

The present invention concerns a doll having its body in an all-fours position, and provided with a mechanism hidden inside its body that transmits combined crawling movement to the arms and legs in order to attain its advance on the ground.

Different mechanisms are well-known in the art through which said crawling movement of the doll arms and legs is produced.

In most cases, the mechanisms are located inside the body, more specifically inside the doll trunk and mainly consist of a set of reducing gears that, through corresponding handles or eccentrics, act on the inner end of the arms at the shoulder level, this movement being related, by means of connecting rods, to the legs, at their inner part at the hip articulation level.

The arms have a support position on the ground. The legs are bent so that the support is made in this case on the knees.

The attraction that these dolls hold out for children as they watch them crawling becomes rather monotonous after some time.

The present invention provides new effects that increase the attraction for children of this kind of crawling doll. With this aim, the mechanism has been provided with some elements that, in a temporary way, modify the crawling effect by a headlong falling one. For this purpose, the doll body has been shaped in an especial way, and has been given an arched shape, so that it falls on the thorax in the falling movement.

To produce this effect the arms are controlled by at least one rotatable plate means connected to an inner arm part of the doll the position of which plate means is determined by a cam, these plate means forming part of a crawl mechanism which causes the doll to crawl. Rotation of this cam causes the arms to make a rotational movement over the shoulders, extending themselves frontwards. The continuation of the cam rotation in a complete cycle causes the return to the normal crawling position of the doll.

This mechanism may also operate a phonographic reproducer or the like. Simultaneously with the doll falling action, the reproducer starts functioning, a baby's weeping sound being then audible, the sound being interrupted when the normal crawling position is resumed.

For a better comprehension of the invention, one embodiment of a preferred mechanism will now be described with reference to the accompanying drawings, by way of example only. In the drawings.

Figure 1:
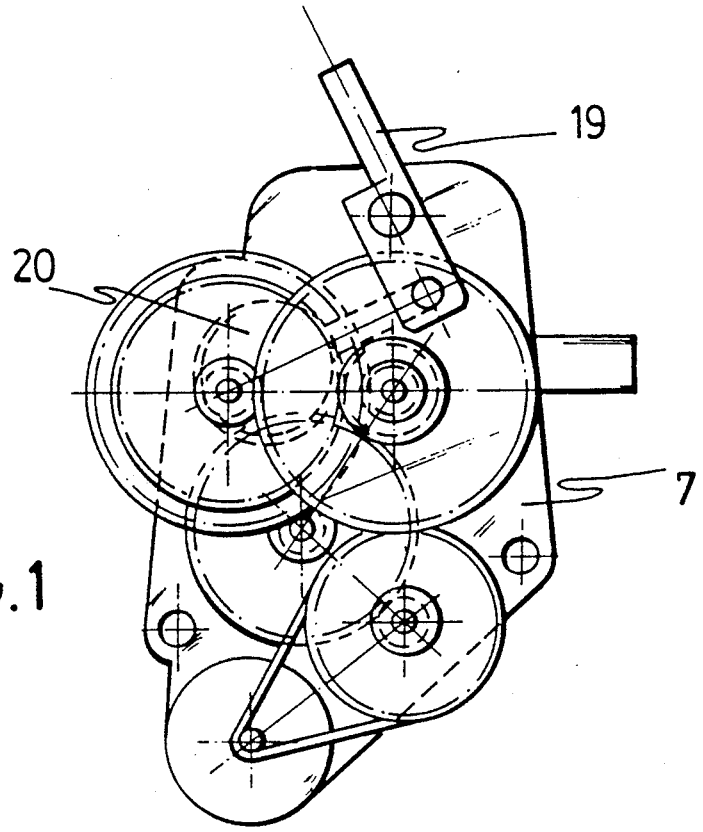
FIG. 1 is a side elevational view of the mechanism.
Figure 2:
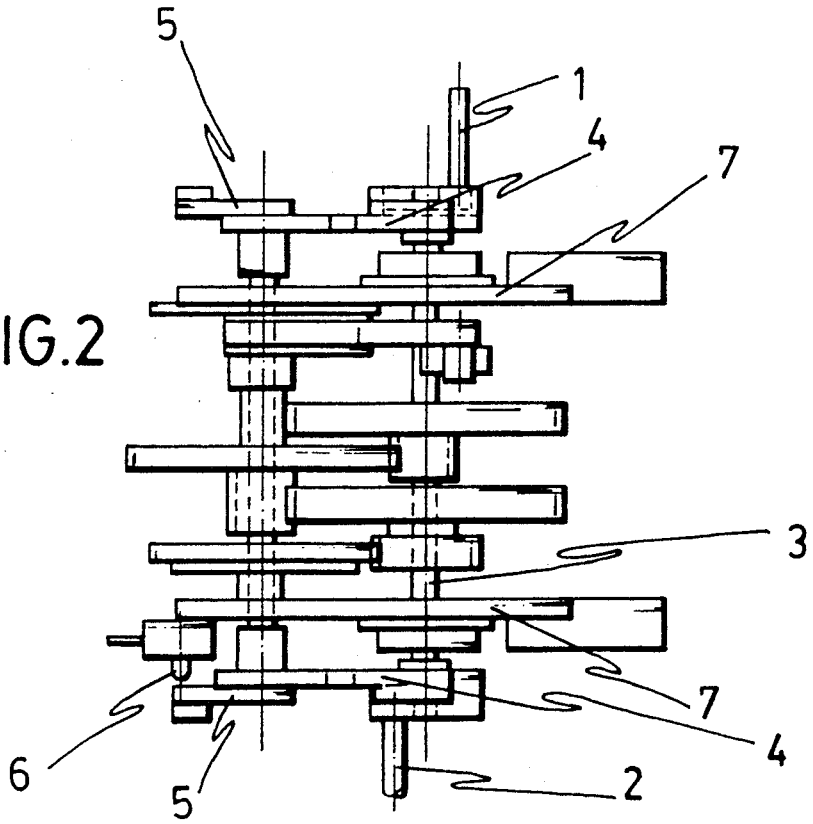
FIG. 2 is a top view.

Reference being thus made to the drawings, FIGS. 1 and 2 show the main shafts with all their attached elements. Particular features of this mechanism are the combination with the eccentric handles 1 and 2 projecting from the shaft 3, of plates 4 which are freely pivoted on the shaft 3 (and which are part of a crawl mechanism which controls movement of the doll arms), as well as of the arched cam 5, a side projection of which closes the pulsator switch 6, which activates temporarily the sound reproducer circuit. The supports 7 bear the whole mechanism inside the body of the doll.

As seen in FIG. 1, a pulley is connected to one of the gears in the mechanism so that the battery fed mechanism, which moves the pulley, causes the interconnected gears and cams in the mechanism to rotate. The rotation of these cams and gears then causes cam 5 to rotate slowly and stem 19 to pivot.

Figure 3:
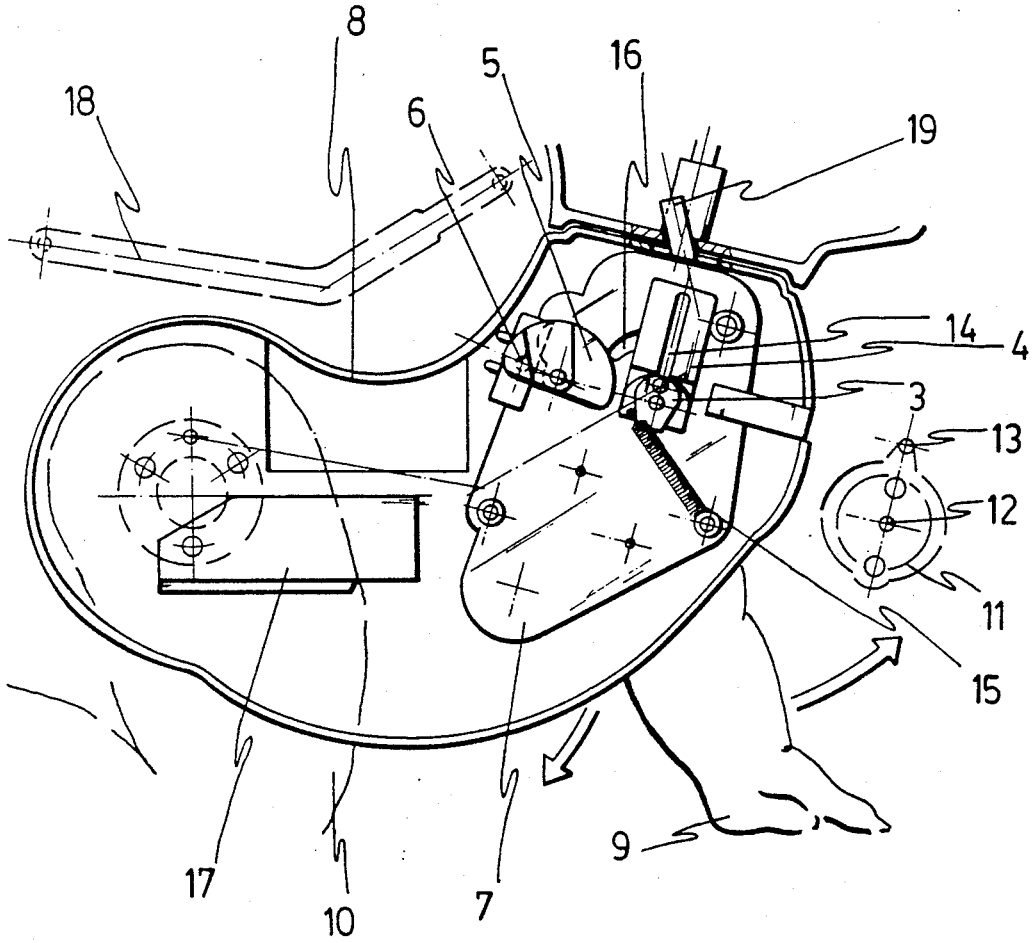
FIG. 3 shows schematically the mechanism within the doll body, showing associated parts.

FIG. 3 represents schematically the doll body, inside which the mechanism is situated. Such as it can be seen in this figure, the doll body 8 has its trunk in an arched position and in crawling attitude, leaning on the hands 9 and on the knees 10 of its bent legs. By means of the mechanism, the arm and the legs perform a movement that determines the displacement of the doll. The pieces 11 correspond to the inner terminal parts of the arms. At the point 12 of each piece 11 is inserted an eccentric handle 1, 2 of the conducted shaft 3, while the eccentric handle 1, 2 of the conducted shaft 3, while the pivot 13 of piece 11 is positioned to slide in the slot 14 of the corresponding plate 4. These plates, by virtue of said assembly, control the major motions of the arms which occur in the falling down, and form part of the crawl mechanism that includes the slots 14, pivots 13, and eccentric handles 1 and 2. The regular crawling motion occurs as handles 1, 2 move the centers of pieces 11 in circular motion while pivots 13 slide in the usually stationary slots 14.

Figure 4:
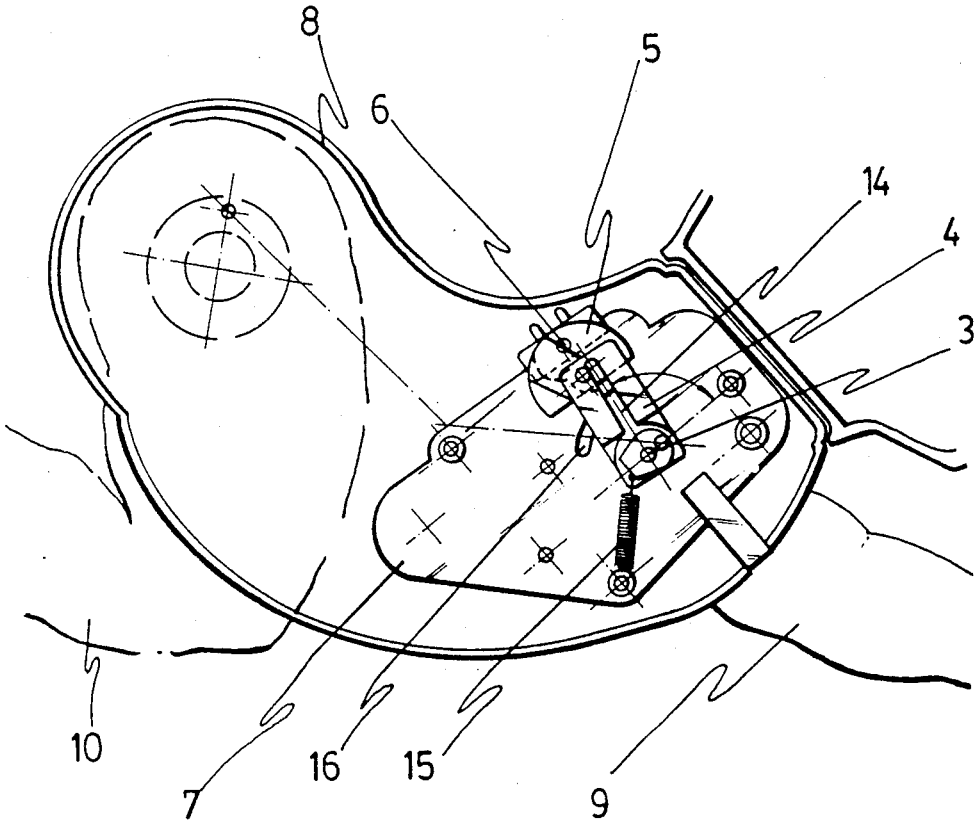
FIG. 4 is a view similar to FIG. 3 but with the parts in a different position.

Spring 15, connected to the plate 4 as shown in FIGS. 3 and 4, causes appendix 16 (which is part of the plate means) to be urged against the convex portion of arched cam 5 when the arms of the doll are in a generally upright position, holding the plate 4 substantially stationary. As the battery fed mechanism causes arched cam 5 to be rotated, appendix 16 approaches the flat (i.e. relatively recessed) portion of cam 5. Once appendix 16 reaches the flat portion of cam 5, appendix 16 becomes disengaged from cam 5 as shown in FIG. 4. As this happens spring 15 pivots plate 4 in a downward direction thereby causing the arms, connected to the plates via pivots 13, to extend forward. A head-down falling movement of the doll is thereby produced. In addition, a projecting side portion of the cam 5 contacts pulsator 6 so as to close a switching mechanism in the pulsator and cause the sound reproducer 17 to be turned on.

As the cam is further rotated, the convex portion again engages appendix 16 so as to pivot the plate in an upward direction thereby causing the arms of the doll to be pivoted down to an upright position. To enhance the crawling motion, connecting rod 18 is connected to the handles 1 and 2 and the legs so that the movement of the handles will cause a corresponding movement in the legs which simulates the crawling motion of a baby.

FIG. 4 shows the doll in the head-down fallen position. It is assumed that the baby it represents was not strong enough to continue walking on all-fours and has stretched out his arms.

Figure 5:
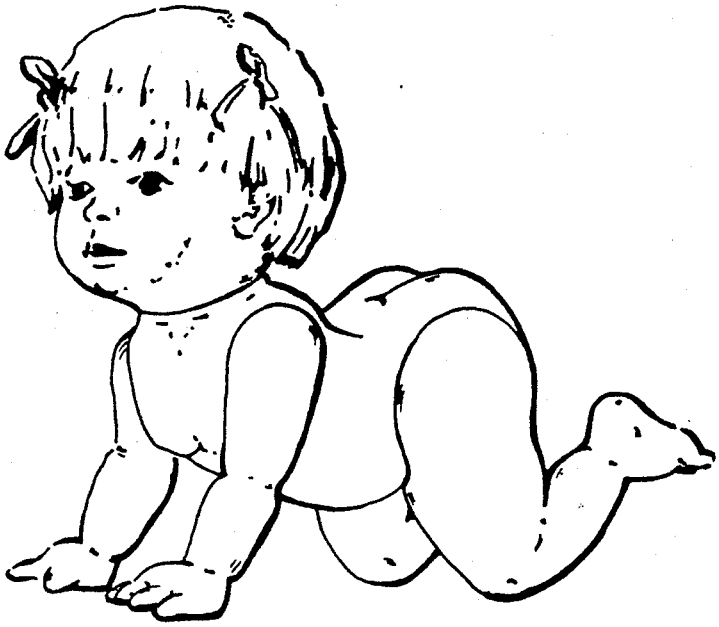
FIGS. 5 and 6 show the doll in crawling and fallen positions, respectively.
Figure 6:
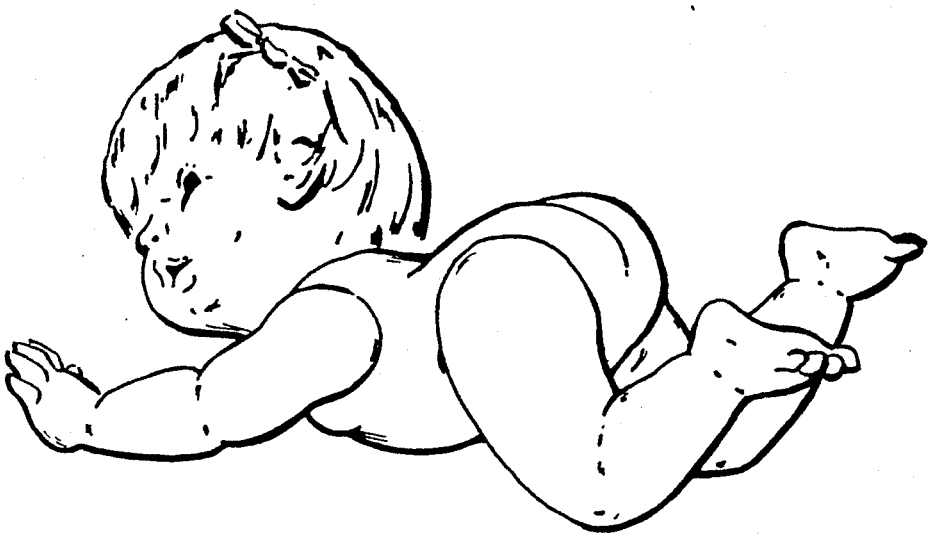

FIG. 5 shows the doll in the all-fours walking position and, finally, FIG. 6 shows it in the head-down fallen position.

The doll will naturally be dressed as necessary in order to give it the appearance one wishes at each given moment.

As mentioned above, the stem 19 is driven by the eccentric 20, as shown in FIG. 3 this stem acts on the doll head to make this oscillate alternatively towards both sides.

I claim:

1. A crawling doll toy that periodically falls down into a head-down fallen position comprising:

movable arms and legs, connected to a body portion, that normally support the body portion; drive mechanism within the body portion connected to said arms and legs by means of a crawl mechanism to cause the doll to crawl and also connected to at least one rotatable cam having a convex surface and a surface which is recessed relative to said convex surface;

at least one rotatable plate means forming part of said crawl mechanism connected to an inner arm part of the doll so as to control the arm movement, said rotatable plate means cooperating with said rotatable cam and being movable between a first position in which the plate means is held against the convex surface of the cam so as to maintain the arm in a generally upright position in which the doll is caused to crawl, and a second position in which the plate means loses contact with the convex surface of the cam when the rotation of the cam by the drive mechanism causes the recessed surface of the cam to be positioned adjacent to the plate means so that the plate means can rotate and allow the arm to extend forward so that the doll acquires said head-down fallen position, continued rotation of the cam causing the plate means to return to the first position so that the doll can resume crawling.

2. A crawling doll toy according to claim 1, wherein a sound reproducer within the body portion, to produce the weeping sounds of a baby, is turned on when a switching portion of the cam contacts and closes a switch connected to the sound reproducer and turns off when the switching portion loses contact with the switch; and wherein the closing of the switch coincides with the head-down fallen position of the doll.

3. A crawling doll toy according to claim 1, wherein the cam is mounted on a first axle of the drive mechanism that is parallel to a second axle of the drive mechanism that rotatably mounts the plate means, said plate means having a slot formed thereon that is engageable by a pivot connected to the inner arm part with said slot and pivot forming part of said crawl mechanism, the arm being caused to move in crawling manner by an eccentric extension of said second axle which moves one portion of the inner arm part while another part thereof slides in said slot.

4. A doll according to claim 1, wherein a swivel mechanism is connected to the drive mechanism and a head part of the doll to cause the head to swivel sideways as the doll crawls, said swivel mechanism including a pivotable stem attached to an eccentric part in the drive mechanism that causes the stem to move, said stem being engageable with a tract means in said head part so that the pivoting of the stem causes the head part to rotate sideways.

5. A doll according to claim 1, wherein a trunk portion of the body portion has an arched shape, so that the head part stands extended frontwards in the all-fours walking-on position, while in the head-down fallen position it is slightly lifted up with respect to the ground, while the trunk portion remains close to the ground.

6. A crawling doll toy according to claim 1, wherein an elastic means, within the body portion and connected to the plate means, urges the plate means against the convex surface of the cam, and wherein said elastic means rotates the plate means and causes the arm to extend forwards when said rotatable cam is in said second position.

* * * * *